US008524646B2

(12) United States Patent
Ricci et al.

(10) Patent No.: US 8,524,646 B2
(45) Date of Patent: Sep. 3, 2013

(54) MULTI-COMPARTMENT POUCH

(75) Inventors: Carlo Ricci, Rome (IT); Luca Sarcinelli, Cerveteri (IT)

(73) Assignee: The Procter & Gamble Company, Cincinnati, OH (US)

( * ) Notice: Subject to any disclaimer, the term of this patent is extended or adjusted under 35 U.S.C. 154(b) by 66 days.

(21) Appl. No.: 13/116,579

(22) Filed: May 26, 2011

(65) Prior Publication Data

US 2011/0303576 A1 Dec. 15, 2011

(30) Foreign Application Priority Data

Jun. 15, 2010 (EP) ..... 10165935

(51) Int. Cl.

| | |
|---|---|
| ***C11D 7/26*** | (2006.01) |
| ***C11D 7/32*** | (2006.01) |
| ***C11D 7/38*** | (2006.01) |
| ***C11D 7/50*** | (2006.01) |
| ***C11D 7/54*** | (2006.01) |
| ***C11D 17/00*** | (2006.01) |

(52) U.S. Cl.

USPC ..... 510/296; 510/310; 510/311; 510/313; 510/361; 510/376; 510/439; 510/499; 510/505; 510/506

(58) Field of Classification Search

USPC ..... 510/296, 310, 311, 313, 361, 376, 510/439, 505, 506, 499

See application file for complete search history.

(56) References Cited

U.S. PATENT DOCUMENTS

| | | | | |
|---|---|---|---|---|
| 7,517,847 | B2 * | 4/2009 | Catalfamo et al. | 510/296 |
| 2003/0087884 | A1 | 5/2003 | MacLaughlan et al. | |
| 2008/0076693 | A1 * | 3/2008 | Sharma et al. | 510/373 |
| 2009/0011970 | A1 | 1/2009 | Evers | |
| 2009/0048134 | A1 | 2/2009 | Roberts | |
| 2009/0233830 | A1 | 9/2009 | Dirr et al. | |

OTHER PUBLICATIONS

International Search Report dated Nov. 16, 2010 (5 pages).

* cited by examiner

*Primary Examiner* — Gregory Delcotto

(74) *Attorney, Agent, or Firm* — Melissa G. Krasovec; Steven W. Miller

(57) ABSTRACT

A multi-compartment pouch comprising a first compartment and a second compartment, wherein, the first compartment comprises a solid composition, wherein the solid composition comprises;

an oxygen bleach source;

a bleach activator;

a polycarboxylate polymer;

and the second compartment comprises a liquid composition, wherein the liquid composition comprises;

a low molecular weight solvent.

18 Claims, No Drawings

MULTI-COMPARTMENT POUCH

FIELD OF THE INVENTION

The present invention is to bleaching compositions in the form of multi-compartment pouches, which exhibit improved stability over time.

BACKGROUND TO THE INVENTION

Unitised doses of detergents and bleaching compositions have been found to be both attractive and convenient to consumers. Indeed, a "unit dose" is easy to handle and avoids the need of the consumer to measure the product, thereby giving rise to more precise dosing and avoiding wasteful overdosing or under-dosing.

It is often advantageous to utilize multi-compartment pouches. In such pouches incompatible ingredients can be split, or both liquid and solid compositions can be utilized. Some ingredients for instance are more stable in solid form than liquid, and vice versa.

The multicompartment pouch is made of a water-soluble film. This film requires the presence of low molecular weight solvent both in the film (added during manufacture, or casting) and in the liquid composition, to act as a plasticizer. Plasticizers in the film increase the plasticity or fluidity of the film, in other words making it strong and elastic. In the absence of plasticizers, the film is brittle. This ensures uniform thickness of the film during the manufacture of the film and subsequent pouch formation, and prevents it from tearing of splitting during manufacture and shipment/storage.

Low molecular weight solvents, which act as plasticizers in the liquid composition, are necessary to increase film elasticity, but also to prevent the film from dissolving during the storage in the presence of water (both atmospheric moisture and water in the liquid composition). Pouch films, such as polyvinyl alcohol are sensitive to several compounds, such as strong acids and bases, and oxidizing compounds. There can also be specific film/product interactions which can decrease the solubility. For example carboxylic groups present in some films can react with hydroxyl groups also in the film, in the presence of di-carboxylic acids (such as citric acid) to form intra-molecular lactone rings or inter-molecular esters. This results in the solubility of the film significantly reducing, and the film becoming opaque during storage.

A preferred bleaching agent is an oxygen bleach. When used in conjunction with bleach activators, oxygen bleaches offer excellent cleaning. The oxygen bleach source and the bleach activator are powder ingredients. In the presence of water, the oxygen bleach source and the bleach activator react together to form free oxygen. If this occurs within the enclosed pouch, it could cause the pouch to rupture.

Furthermore, often, the bleach activator is coated with palmitic acid. Palmitic acid is a relatively inert saturated fatty acid. Its presence helps minimise hydrolysis of the bleach activator in the presence of alkaline ingredients in the composition. Reaction between the oxygen bleach source and the bleach activator (caused by the presence of water and/or solvents) can oxidize the palmitic acid. For example, if the oxygen bleach source is peroxide, then peracid is formed that reacts strongly with the palmitic acid. This oxidation of palmitic acid forms a yellow product which causes yellowing of the powder composition.

Moreover, the reaction of the oxygen bleach source and bleach activator in the presence of water, causes plasticization of the film. This is due to the reaction of, for example, peracid with the alcoholic group and acetate sites of the film, destroying the polymer structure.

Interestingly, it was found that the low molecular weight solvent was migrating from the liquid composition into the solid composition and causing the bleach activator to react with the bleach oxygen source. This caused the above mentioned problems and also resulted in overall lower levels of bleaching compounds, thus affected the cleaning efficiency.

Therefore, there is a need to provide multi-compartment pouches comprising an oxygen bleach source and bleach activator, which exhibit improved stability over time.

Surprisingly, the incorporation of a polycarboxylate polymer in the solid composition reduced the amount of low molecular weight solvent migrating from the liquid composition into the solid composition and resulted in reduced bleach activator and oxygen bleach source reaction. This resulted in overall improved compositional and pouch stability over time.

SUMMARY OF THE INVENTION

The present invention is to a multi-compartment pouch comprising a first compartment and a second compartment, wherein, the first compartment comprises a solid composition, wherein the solid composition comprises;
- an oxygen bleach source;
- a bleach activator;
- a polycarboxylate polymer;

and the second compartment comprises a liquid composition, wherein the liquid composition comprises;
- a low molecular weight solvent.

DESCRIPTION OF THE INVENTION

The Pouch

The multi-compartment pouch of the present invention, comprises a first compartment and a second compartment. The first compartment comprises a solid composition, and the second compartment comprises a liquid composition.

The multi-compartment pouch of the present invention, herein referred to as "pouch", is typically a closed structure, made of materials described herein, enclosing a volume space which is separated into at least two compartments.

The pouch can be of any form, shape and material which is suitable to hold the compositions, e.g. without allowing the release of one or more of the compositions from the pouch prior to contact of the pouch with water. The exact execution will depend, for example, on the type and amount of the compositions in the pouch, the number of compartments in the pouch, and on the characteristics required from the pouch to hold, protect and deliver or release the compositions.

The pouch may be of such a size that it conveniently contains either a unit dose amount of the compositions herein, suitable for the required operation, for example one wash, or only a partial dose, to allow the consumer greater flexibility to vary the amount used, for example depending on the size and/or degree of soiling of the wash load.

Another characteristic of the present invention is that the pouch is made from a water-soluble film which encloses an inner volume; said inner volume is divided into the compartments of the pouch.

The compartments of the pouch herein defined are closed structures, made from a water-soluble film which encloses a volume space which comprises the solid component or the liquid component of the composition. Said volume space is preferably enclosed by a water-soluble film in such a manner that the volume space is separated from the outside environment. The solid or liquid components that are comprised by the compartment of the pouch are contained in the volume space of the compartment, and are separated from the outside environment by a barrier of water-soluble film.

The term "separated" means for the purpose of this invention "physically distinct, in that a first ingredient comprised by a compartment is prevented from contacting a second ingredient if the second ingredient is not comprised by the same compartment which comprises the first ingredient".

The term "outside environment" means for the purpose of this invention "anything which cannot pass through the water-soluble film which encloses the compartment and which is not comprised by the compartment".

The compartment is suitable to hold the solid or liquid component, e.g. without allowing the release of the components from the compartment prior to contact of the pouch with water. The compartment can have any form or shape, depending on the nature of the material of the compartment, the nature of the components or composition, the intended use, amount of the components etc.

It may be preferred that the compartment which comprises the liquid component also comprises an air bubble, preferably the air bubble has a volume of no more than 50%, preferably no more than 40%, more preferably no more than 30%, more preferably no more than 20%, more preferably no more than 10% of the volume space of said compartment. Without being bound by theory, it is believed that the presence of the air bubble increases the tolerance of the pouch to the movement of the liquid component within the compartment, thus reducing the risk of the liquid component leaking from the compartment.

The pouch material is water soluble. Preferably, the pouch material is in the form of a water-soluble film; said water-soluble film typically has a solubility of at least 50%, preferably at least 75% or even at least 95%, as measured by the Gravimetric method for determining water-solubility of the material of the pouch set out hereinafter using a glass-filter with a maximum pore size of 50 microns;

10 grams±0.1 gram of material is added in a 400 ml beaker, whereof the weight has been determined, and 245 ml±1 ml of distilled water is added. This is stirred vigorously on a magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the percentage solubility or dispersability can be calculated.

Preferably, the film comprises polymeric materials, preferably polymers which are formed into a film or sheet. The film can for example be obtained by casting, blow-molding, extrusion or blow extrusion of the polymer material, using methods known in the art. The polymeric material can be a polymer, copolymers or derivatives thereof. Preferably, the polymeric material is selected from the group comprising polyvinyl alcohols, polyvinyl alcohol substituted with sulphate, carbonate or citrate or mixtures thereof, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol copolymers and hydroxypropyl methyl cellulose (HPMC). In one embodiment, the polymeric material is polyvinyl alcohol (PVA).

Preferably, the level of polymer in the film is at least 60%.

The polymeric material can have any weight average molecular weight, preferably from about 1000 to 1,000,000, or even from 10,000 to 300,000 or even from 15,000 to 200,000 or even from 20,000 to 150,000.

Mixtures of polymers can also be used. This may in particular be beneficial to control the mechanical and/or dissolution properties of the compartments or pouch, depending on the application thereof and the required needs. For example, it may be preferred that a mixture of polymers is present in the film, whereby one polymer material has a higher water-solubility than another polymer material, and/or one polymer material has a higher mechanical strength than another polymer material. It may be preferred that a mixture of polymers is used, having different weight average molecular weights, for example a mixture of polyvinyl alcohol or a copolymer thereof of a weight average molecular weight of 10,000-40,000, preferably around 20,000, and of polyvinyl alcohol or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising from 1% to 35% by weight polylactide and approximately from 65% to 99% by weight polyvinyl alcohol, for the material to be water-soluble.

It may be preferred that the polymer present in the film is from 60% to 98%, preferably 80% to 90% hydrolysed, to improve the dissolution of the material.

Most preferred are films which comprise a polyvinyl alcohol polymer with similar properties to the film which comprises a polyvinyl alcohol polymer and is known under the trade reference M8630, as sold by Chris-Craft Industrial Products of Gary, Ind., US, or by Monosol.

The film herein may comprise further additive ingredients. For example, it may be beneficial to add plasticisers, for example dipropylene glycol, ethylene glycol, diethyleneglycol, propylene glycol, glycerol, sorbitol, mannitole, and mixtures thereof, additional water, disintegrating aids.

Suitable examples of commercially available water-soluble films include polyvinyl alcohol and partially hydrolysed polyvinyl acetate, alginates, cellulose ethers such as carboxymethylcellulose and methylcellulose, polyethylene oxide, polyacrylates and combinations of these.

The pouch can be prepared according to methods known in the art. The pouch is typically prepared by first cutting an appropriately sized piece of the pouch material. The pouch material is then folded to form the necessary number and size of compartments and the edges are sealed using any suitable technology, for example heat sealing, wet sealing or pressure sealing. Preferably, a sealing source is brought into contact with the pouch material, heat or pressure is applied and the pouch material is sealed.

The pouch material is typically introduced to a mold and a vacuum applied so that the pouch material is flush with the inner surface of the mold, thus forming a vacuum formed indent or niche in said pouch material. This is referred to as vacuum-forming. Another suitable method is thermo-forming. Thermo-forming typically involves the step of forming an open pouch in a mold under application of heat, which allows the pouch material to take on the shape of the mold.

Typically more than one piece of pouch material is used for making multi-compartment pouches. For example, a first piece of pouch material can be vacuum pulled into the mold so that said pouch material is flush with the inner walls of the mold. A second piece of pouch material can then be positioned such that it at least partially overlaps, and preferably completely overlaps, with the first piece of pouch material. The first piece of pouch material and second piece of pouch material are sealed together. The first piece of pouch material and second piece of pouch material can be made of the same type of material or can be different types of material.

In a preferred process, a piece of pouch material is folded at least twice, or at least three pieces of pouch material are used, or at least two pieces of pouch material are used wherein at least one piece of pouch material is folded at least once. The third piece of pouch material, or a folded piece of pouch material, creates a barrier layer that, when the pouch is sealed, divides the internal volume of said pouch into at least two or more compartments.

The pouch can also be prepared by fitting a first piece of the pouch material into a mold, for example the first piece of film may be vacuum pulled into the mold so that said film is flush with the inner walls of the mold. A composition, or component thereof, is typically poured into the mold. A pre-sealed compartment made of pouch material, is then typically placed over the mold containing the composition, or component thereof. The pre-sealed compartment preferably contains a composition, or component thereof. The pre-sealed compartment and said first piece of pouch material may be sealed together to form the pouch.

Solid Composition

A first compartment of the multi-compartment pouch comprises a solid composition. The solid composition of the present invention comprises an oxygen bleach source, a bleach activator and a polycarboxylate polymer.

The Oxygen Bleach Source

As an essential ingredient, the solid composition according to the present invention comprises an oxygen bleach source. Preferably said oxygen bleach is a peroxygen source, more preferably a hydrogen peroxide source.

In one embodiment, the peroxygen source is an inorganic perhydrate salt. Inorganic perhydrate salts are normally the alkali metal salts. Preferably, the inorganic perhydrate salt is selected from the group comprising perborate, percarbonate, perphosphate and persilicate salts. In another embodiment, the perhydrate salt is selected from perborate and percarbonate. In one embodiment, the perhydrate salt is percarbonate, preferably sodium percarbonate.

Sodium percarbonate has the formula corresponding to $2Na_2CO_3\ 3H_2O_2$. To enhance storage stability, the sodium percarbonate can be coated, for example, with a further mixed salt of an alkali metal sulphate and/or carbonate. Such coatings together with coating processes have previously been described in GB 1466799. The weight ratio of the mixed salt coating material to the sodium percarbonate is from 1:2000 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably is from 0.3 to 1.0 and most preferably n is from 0.2 to 0.5. In one embodiment, the sodium percarbonate is coated with Boric acid.

Other suitable oxygen bleach sources include persulphates, particularly potassium persulphate $K_2S_2O_8$ and sodium persulphate $Na_2S_2O_8$.

Commercially available carbonate/sulphate coated sodium percarbonate may include a low level of a heavy metal sequestrant such as ethylenediaininetetraacetic acid (EDTA), 1-hydroxyethylidene 1,1-diphosphonic acid (HEDP) or an aminophosphonate, that is incorporated during the manufacturing process. These sequesterants are used, as decomposition of oxygen bleach source, for example peroxide, is strongly catalyzed by free heavy metals (mainly Fe, Cu, Co, Mn, Cr). Thus the presence of sequestrants decreases the level of free heavy metals present at equilibrium, and consequently reduces the peroxide decomposition.

Preferred heavy metal sequestrants for incorporation as described herein above include the organic phosphonates and amino alkylene poly(alkylene phosphonates) such as the alkali metal ethane 1-hydroxy diphosphonates, the nitrilo trimethylene phosphonates, the ethylene diamine tetra methylene phosphonates and the diethylene triamine penta methylene phosphonates.

In another embodiment, the oxygen bleach source comprises a peroxy carboxylic acid (hereafter referred to as peracid). Preferred peracids are those having general formula:

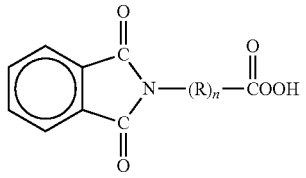

wherein R is selected from C1-4 alkyl and n is an integer of from 1 to 5.

In a particularly preferred aspect of the present invention the peracid has the formula such that R is $CH_2$ and n is 5 i.e. phthaloyl amino-peroxy caproic acid or PAP. The peracid is preferably used as a substantially water-insoluble solid compound and is available from Solvay/Ausimont under the tradename Euroco®.

Typically, the compositions of the present invention comprise from 10% to 80%, preferably from 15% to 70% and more preferably from 20% to 60%, by weight of the solid composition, of an oxygen bleach source.

Bleach Activators

As an essential ingredient, the solid composition according to the present invention comprises a bleach activator.

In a preferred embodiment, the bleach activator used in the solid composition has the general formula:

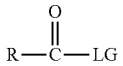

wherein R is an alkyl group, linear or branched, containing from about 1 to 11 carbon atoms and LG is a suitable leaving group. As used herein, a "leaving group" is any group that is displaced from the bleach activator as consequence of nucleophilic attack on the bleach activator by the perhydroxide anion, i.e. perhydrolysis reaction.

Generally, a suitable leaving group is electrophilic and is stable such that the rate of the reverse reaction is negligible. This facilitates the nucleophilic attack by the perhydroxide anion. The leaving group must also be sufficiently reactive for the reaction to occur within the optimum time frame, for example during the wash cycle. However, if the leaving group is too reactive, the bleach activator will be difficult to stabilize. These characteristics are generally paralleled by the pKa of the conjugate acid of the leaving group, although exceptions to this convention are known. The conjugate acid of the leaving group in accordance with the present invention preferably has a pKa in a range from about 4 to about 13, more preferably from about 6 to about 11, and most preferably from about 8 to about 11.

Preferably, the leaving group has the formula:

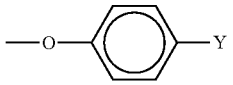

wherein Y is selected from the group consisting of $SO_3^-M^+$, $COO^-M^+$, $SO_4^-M^+$, $PO_4^-M^+$, $PO_3^-M^+$. $(N^+R^2_3)X^-$ and $O\leftarrow N(R^2_2)$, M is a cation and X is an anion, both of which provide solubility to the bleach activator, and $R^2$ is an alkyl chain containing from about 1 to about 4 carbon atoms or H. In accordance with the present invention, M is preferably an alkali metal, with sodium being most preferred. Preferably, X is a hydroxide, methylsulfate or acetate anion.

Other suitable leaving groups have the following formulas

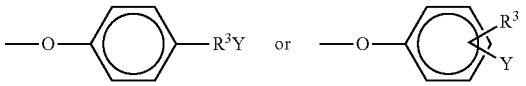

wherein Y is the same as described above and $R^3$ is an alkyl chain containing from about 1 to about 8 carbon atoms, H or $R^2$.

While numerous bleach activators as described above are suitable for use in the present invention, a preferred bleach activator has the formula:

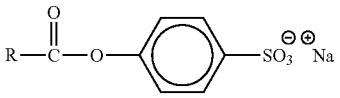

wherein R is an alkyl chain, linear or branched, containing from 1 to 11 carbon atoms. More preferably, R is an alkyl chain, linear or branched, containing from 3 to 11, even more preferably from 8 to 11.

Most preferably, according to the present invention, the bleach activator has the formula:

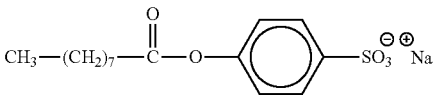

which is also referred to as sodium n-nonyloxybenzene sulfonate (hereinafter referred to as "NOBS").

This bleach activator and those described previously may be readily synthesized by well known reaction schemes or purchased commercially. Those skilled in the art will appreciate that other bleach activators beyond those described herein which are readily water-soluble can be used in the solid composition without departing from the scope of the invention.

The compositions of the present invention comprise from 1% to 40%, preferably from 2% to 30% and more preferably from 3% to 20%, by weight of the solid composition of a bleach activator.

In one embodiment, the bleach activator can be a mixture of bleach activators. Preferred mixtures of bleach activators herein comprise n-nonanoyloxybenzene-sulphonate (NOBS) together with a second bleach activator having a low tendency to generate diacyl peroxide, but which delivers mainly peracid.

The second bleach activators may include tetracetyl ethylene diamine (TAED), acetyl triethyl citrate (ATC), acetyl caprolactam (ACL), benzoyl caprolactam (BCL) and the like, or mixtures thereof. Indeed, it has been found that mixtures of bleach activators comprising n-nonanoyloxybenzene-sulphonate and the second bleach activators, contribute to further boost particulate soil removal performance while exhibiting at the same time good performance on diacyl peroxide sensitive soil (e.g., beta-carotene) and on peracid sensitive soil (e.g., body soils).

The bleach activator may also be coated with a relatively inert material. It is preferable that this material helps prevent the hydrolysis of the bleach activator in the presence of alkali materials in the composition. However, it is preferably that the coating is water soluble so that the bleach activator is free to react with the oxygen bleach source in the presence of water. In one embodiment, the bleach activator is coated with palmitic acid.

Polycarboxylate Polymer

An essential ingredient of the present invention is a polycarboxylate polymer. As used herein, "polycarboxylate" refers to compounds having a plurality of carboxylate groups, preferably at least 3 carboxylases.

The polycarboxylate polymer of the present invention has a molecular weight in the range from 1000 to 200,000, preferably from 5000 to 100,000, and most preferably the molecular weight is 70,000.

The polycarboxylate copolymer is generally added to the composition in acid form, but can also be added in the form of a neutralized salt, such as sodium polycarboxylate or potassium polycarboxylate. When utilized in salt form, alkali metals, such as sodium, potassium, and lithium, or alkanolammonium salts are preferred. In one embodiment, the polycarboxylate polymer is an acrylic acid homopolymer. In a preferred embodiment, the polycarboxylate polymer is a copolymer of acrylic acid and maleic acid having the following formula;

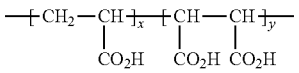

wherein x and y are each independently from 5 to 1000. Suitable polymers are commercially available from BASF under the trade name of Sokolan CP5.

In one embodiment, the polycarboxylate polymer is a spray dried copolymer of acylic acid and maleic acid. Preferably, the spray dried copolymer of acylic acid and maleic acid has a molecular weight in the range from 1000 to 200,000, preferably from 5000 to 100,000, and most preferably the molecular weight is 70,000.

Other useful polycarboxylate polymers include the ether hydroxypolycarboxylates, copolymers of maleic anhydride with ethylene or vinyl methyl ether, 1,3,5-trihydroxy benzene-2,4,5-trisulfonic acid, and carboxymethyloxysuccinic acid, the various alkali metals, ammonium and substituted ammonium salts of polyacetic acids such as nitrilotriacetic acid, as well as polycarboxylates such as benzene hexacarboxylic acid, succinic acid, oxydisuccinic acid, polymaleic acid, benzene 1,3,5-tricarboxylic acid, carboxymethyloxysuccinic acid, and soluble salts thereof. Suitable polycarboxylate polymers are commercially available from Rohm & Haas under the trade name of Acusol.

The solid composition comprises from 0.5% to 10%, preferably, 1.5% to 10%, more preferably 3% to 10%, by weight of the solid composition of the polycarboxylate polymer.

Liquid Composition

A second compartment of the multi-compartment pouch comprises a liquid composition. The liquid composition of the present invention comprises a low molecular weight solvent.

Preferably, the liquid component is substantially liquid in that at least 90%, more preferably at least 95%, more preferably at least 98% of the ingredients comprised by the liquid component are in a liquid form at room temperature.

Low Molecular Weight Solvent

Without wishing to be bound by theory, the low molecular weight solvent increases the plasticity or flexibility of the pouch film, thus ensuring it does not crack or split. In the absence of low molecular weight solvent, the pouch film is brittle. The handling by the consumer of a brittle pouch film, could be enough for to crack or split. This issue is compounded by movement of the liquid composition within the pouch. As the liquid moves in the pouch it can push and stretch the pouch film in localized areas. If the pouch film is too brittle, it can cause it to crack or split. Furthermore, the low molecular weight solvent helps minimize the hydrolysis of the film in the presence of water in the liquid composition and in the atmosphere. A further benefit, is that the low molecular weight solvent also helps control the viscosity of the liquid composition. This has implications in the manufacturing process. If the viscosity is too low, then the liquid can 'splash' out of the pouch when is being injected during the manufacturing step. This can lead to incorrect volumes being present in the pouch. Likewise, if the liquid is too viscous, it cannot be injected.

Preferably, the low molecular weight solvent comprises compounds selected from the group comprising diethylene glycol, diethylene glycol mono propyl ether, diethylene glycol mono butyl ether, dipropylene glycol and mixtures thereof. In one embodiment, the low molecular weight solvent comprises dipropylene glycol. It is preferable to use dipropylene glycol, as unlike other low molecular weight solvents, the use of dipropylene glycol does result in the film having a 'greasy' or 'oily' feel, which the consumer finds undesirable.

Preferably, the water soluble pouch material is in the form of a film, and the film comprises polyvinyl alcohol. As detailed above, the pouch film may also comprise low molecular weight solvents. The low molecular weight solvent present in the liquid composition is in addition to any low molecular weight solvent present in the film.

In one embodiment, the low molecular weight solvent comprises glycerol. In one embodiment, the low molecular weight solvent comprises dipropylene glycol and glycerol.

Glycerol acts as an excellent plasticizer, however, at higher levels it makes the film feel 'greasy' or 'oily'. In one embodiment, the ratio of dipropylene glycol to glycerol is between 35:1 and 13:1. At this ratio, the plasticizing benefit of glycerol is still apparent, however, the adverse 'greasy' or 'oily' feel to the film is avoided.

Preferably, the liquid composition comprises from 10% to 95%, more preferably from 20% to 85%, more preferably from 30% to 75% by weight of the liquid composition of a low molecular weight solvent. Preferably, the low molecular weight solvent comprises dipropylene glycol, the dipropylene glycol being present from 10% to 90% more preferably from 20% to 80%, more preferably from 30% to 70% by weight of the liquid composition.

Polyamine

In one embodiment, the liquid component comprises a polyamine. The polyamine serves to dissolve soil stains and provides for improved cleaning. The polyamine preferably has the following formula;

Formula 1

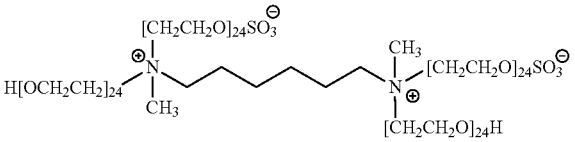

The polyamine is incorporated into the liquid as it is highly reactive with the oxygen bleach source which is in the powder composition.

The liquid composition of the present invention comprises less than 9% total water content. By total water content, we herein mean both free water and water that is bound by other compounds in the liquid composition.

The solid and/or liquid compositions of the present invention may also comprise other optional conventional ingredients commonly used in laundry composition, selected from the group comprising surfactants, building agents, chelating agents, dye, polymers, brighteners, enzymes, suds boosters, suds suppressors, organic solvents, perfumes, perfume microcapsules and mixtures thereof. Preferably, the composition comprises at least one surfactant and at least one building agent.

EXAMPLES

The following multi-compartment pouches of Table 1 were prepared;

TABLE 1

| | Pouch A | Pouch 1 | Pouch 2 | Pouch 3 | Pouch 4 |
|---|---|---|---|---|---|
| Ingredient % w/w in powder composition | | | | | |
| Oxygen bleach source[1] | 46.85 | 46.85 | 46.85 | 46.85 | 46.85 |
| NOBS[2] | 16.40 | 16.40 | 16.40 | 16.40 | 16.40 |
| DTPA[3] | 0.48 | 0.48 | 0.48 | 0.48 | 0.48 |
| Perfume | 0.91 | 0.91 | 0.91 | 0.91 | 0.91 |
| Filler[4] | 23.83 | 23.83 | 23.83 | 23.83 | 23.84 |
| Carbonate | 9.53 | 8.03 | 6.53 | 4.77 | 0 |
| Protease[5] | 0.71 | 0.71 | 0.71 | 0.71 | 0.71 |
| Natalase[6] | 1.29 | 1.29 | 1.29 | 1.29 | 1.29 |
| polycarboxylate polymer[7] | 0 | 1.5 | 3 | 4.76 | 9.52 |
| Ingredient % w/w in Liquid composition | | | | | |
| Dipropylene glycol | 68.98 | 68.98 | 68.98 | 68.98 | 68.98 |
| Glycerol | 2.00 | 2.00 | 2.00 | 2.00 | 2.00 |
| Water (added with the polyamine) | 8.69 | 8.69 | 8.69 | 8.69 | 8.69 |
| Liquitint Orange 272 (dye) | 0.06 | 0.06 | 0.06 | 0.06 | 0.06 |

[1]sodium percarbonate

[2]sodium n-nonyloxybenzene sulfonate

[3]Chelant agent. Mix of Penta-tetra-sodium diethylene triamminopentaacetate and anhydrous aluminosilicate.

[4]Mixture of 32.8% Sodium Silicate, 13.2% Soda Ash, 39.5%, Sodium Sulphate, 6.9% Caustic soda, 7.6% Minors/water, by weight of the filler composition.

[5]Commercially available as FN3D3BS8 from Genencor.

[6]Commercially available as Natalase 90CT from Novozymes.

[7]Commercially available as Sokolan CP5 from Basf.

Pouch A is comparative and outside of the scope of the present invention.

The pouches were stored for 8 weeks at 32° C. and in 80% relative humidity in a climatic chamber type MMM Group Climacell 111, manufacturing Quality Test Protocol QZJ 11/01-02 (error on humidity +/−2%, error on temperature +/−0.5° C.). Following this, the percentage of NOBS recovered by weight of the NOBS originally added to the solid composition was measured with UV via high pressure liquid chromatography (HPLC) using a Phenomenex Sphereclone ODS (C18) column. Samples were tested in an aqueous solution and compared to standard samples. Results can be seen in Table 2.

The pouches were also visually graded for their consumer noticeable aesthetic qualities. The pouches of Table 1 were compared to standard pouches;

"Perfect pouches" (no damage);

"Good Pouches" (minor powder yellowing, but not consumer noticeable);

"Medium Pouches" (deformation of pouches, film relaxing and/or plasticizing, consumer noticeable);

"Poor Pouches" (leakage, consumer noticeable).

Table 2 results represent an average of 10 replicates.

TABLE 2

| | % maleic acid/acrylic acid copolymer present in solid composition by weight of solid composition | % NOBS recovered, by weight of NOBS added to the solid compositon | Visual grading |
|---|---|---|---|
| Pouch A | 0 | 27 | poor |
| Pouch 1 | 1.50 | 58 | medium |
| Pouch 2 | 3.00 | 63 | Medium/good |
| Pouch 3 | 4.76 | 67 | Medium/good |
| Pouch 4 | 9.52 | 82 | good |

As can be seen from Table 2, the presence of maleic acid/acrylic acid copolymer results in increased recovery of NOBS, and improved results upon visual grading.

Without wishing to be bound by theory, it is believed that moisture in the environment crosses through the pouch film and into the solid composition. This increase in moisture, partly contributes to the breakdown of the bleach activator and oxygen bleach source, but also encourages the migration of the low molecular weight solvent from the liquid composition. This then interacts with the bleach activator and causes it to break down. The presence of the polycarboxylate polymer serves to decrease the moisture level in the solid composition so discouraging the migration of the low molecular weight solvent.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-compartment pouch comprising a first compartment and a second compartment, wherein, the first compartment comprises a solid composition, wherein the solid composition comprises:

a) an oxygen bleach source;

b) a bleach activator having the formula:

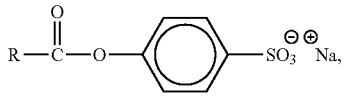

wherein R is an alkyl chain, linear or branched, containing from 1 to 11 carbon atoms; and c) a polycarboxylate polymer, wherein the polycarboxylate polymer is a maleic acid/acrylic acid copolymer having the following formula:

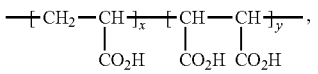

wherein x and y are integers and each independently selected from 5 to 1000;

and the second compartment comprises a liquid composition, wherein the liquid composition comprises:

a low molecular weight solvent selected from the group consisting of diethylene glycol, diethylene glycol mono propyl ether, diethylene glycol mono butyl ether, dipropylene glycol, glycerol, and mixtures thereof; and wherein the liquid composition further comprises a polyamine having the formula:

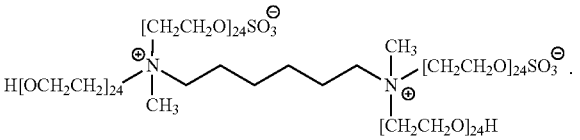

2. The multi-compartment pouch of claim 1, wherein the polycarboxylate polymer has a molecular weight between about 1000 g/mol and about 200,000 g/mol.

3. The multi-compartment pouch of claim 2, wherein the polycarboxylate polymer has a molecular weight between about 5000 g/mol and about 100,000 g/mol.

4. The multi-compartment pouch of claim 1, wherein the polycarboxylate polymer is present in the solid composition in an amount from about 0.5% to about 10%, by weight of the solid composition.

5. The multi-compartment pouch of claim 4, wherein the polycarboxylate polymer is present in the solid composition in an amount from about 1.5% to about 10%, by weight of the solid composition.

6. The multi-compartment pouch of claim 5, wherein the polycarboxylate polymer is present in the solid composition in an amount from about 3% to about 10%, by weight of the solid composition.

7. The multi-compartment pouch of claim 1, wherein the oxygen bleach source comprises a peroxy carboxylic acid.

8. The multi-compartment pouch of claim 7, wherein the peroxy carboxylic acid is phthaloyl amino-peroxy caproic acid.

9. The multi-compartment pouch of claim 1, wherein the low molecular weight solvent is present in the liquid composition in an amount from about 10% to about 95% by weight of the liquid composition.

10. The multi-compartment pouch of claim 9, wherein the low molecular weight solvent is present in the liquid composition in an amount from about 20% to about 85%, by weight of the liquid composition.

11. The multi-compartment pouch of claim 10, wherein the low molecular weight solvent is present in the liquid composition in an amount from about 30% to about 75% by weight of the liquid composition.

12. The multi-compartment pouch of claim 1, wherein the low molecular weight solvent present in the liquid composition comprises dipropylene glycol.

13. The multi-compartment pouch of claim 12, wherein the dipropylene glycol is present in the liquid composition in an amount from about 10% to about 90% by weight of the liquid composition.

14. The multi-compartment pouch of claim 12, wherein the low molecular weight solvent comprises dipropylene glycol and glycerol.

15. The multi-compartment pouch of claim 1, wherein the pouch material is in the form of a water-soluble film.

16. The multi-compartment pouch of claim 15, wherein the film comprises a polyvinyl alcohol polymer.

17. The multi-compartment pouch of claim 1, wherein the low molecular weight solvent comprises dipropylene glycol and glycerol, wherein the ratio of dipropylene glycol to glycerol is between 35:1 and 13:1.

18. A multi-compartment pouch comprising a first compartment and a second compartment, wherein the first compartment comprises a solid composition, wherein the solid composition comprises:

a) an oxygen bleach source;

b) a bleach activator; and c) a polycarboxylate polymer;

and the second compartment comprises a liquid composition, wherein the liquid composition comprises:

a low molecular weight solvent selected from the group consisting of diethylene glycol, diethylene glycol mono propyl ether, diethylene glycol mono butyl ether, dipropylene glycol, glycerol, and mixtures thereof; and a polyamine having the formula:

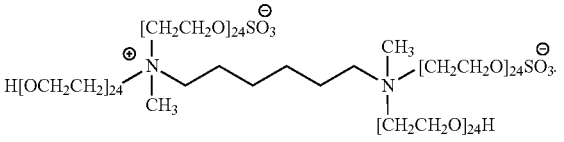

* * * * *